US006824250B1

(12) United States Patent
Adachi et al.

(10) Patent No.: US 6,824,250 B1
(45) Date of Patent: Nov. 30, 2004

(54) INK JET APPARATUS

(75) Inventors: Kouichi Adachi, Shizuoka (JP); Isao Suzuki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/610,860

(22) Filed: Jun. 30, 2003

(51) Int. Cl.[7] ..... B41J 2/04
(52) U.S. Cl. ..... 347/54
(58) Field of Search ..... 347/54, 68, 70, 347/69, 71, 72, 50, 40, 20, 44, 47, 27, 63; 399/261; 361/700; 310/328–330; 29/890.1

(56) References Cited

U.S. PATENT DOCUMENTS

2003/0081063 A1 5/2003 Stanton et al.
2003/0233955 A1 * 12/2003 Mori ..... 101/454

FOREIGN PATENT DOCUMENTS

EP 0 468 712 A2 1/1992
EP 0 960 733 A2 12/1999
JP 07-090210 A 4/1995

* cited by examiner

*Primary Examiner*—Raquel Yvette Gordon
(74) *Attorney, Agent, or Firm*—Frishauf, Holtz, Goodman & Chick, P.C.

(57) ABSTRACT

In the ink jet apparatus according to the present invention, an ink repellent layer similar to that having an ink repellent property satisfying a slide-down speed—as determined by a slide-down speed evaluation method for measuring a slide-down speed of ink droplets by immersing a test piece having the ink repellent layer formed on the surface thereof in an ink similar to another ink curable by radiation and used in the ink jet apparatus, pulling the test piece out of the ink, fixing the test piece at 45 degrees with respect to a horizontal plane, and dropping 10 to 20 $\mu$l of the ink to the fixed test piece—of 2 mm/sec or greater at 25° C. either just after immersion or 100 hours after immersion is formed on at least a peripheral surface of the nozzle which surface constitutes an ink-ejection-side surface of the orifice plate. This contributes to the stabilization of the straight ejection property of ink droplets.

14 Claims, 3 Drawing Sheets

Fig. 5

| COMPARATIVE EXAMPLES | INK | INK REPELLENT LAYER | FLOW SPEED (mm/sec) | APPEARING FREQUENCY OF MISFIRING NOZZLES |
|---|---|---|---|---|
| COMPARATIVE EXAMPLE1 | INK1 | FEP | 0.5 | × |
| COMPARATIVE EXAMPLE2 | INK2 | FEP | 2.0 | ○ |
| COMPARATIVE EXAMPLE3 | INK3 | FEP | 8.0 | ◎ |
| COMPARATIVE EXAMPLE4 | INK1 | FLUORINE-CONTAINING HETEROCYCLIC STRUCTURE | 1.6 | △ |
| COMPARATIVE EXAMPLE5 | INK2 | FLUORINE-CONTAINING HETEROCYCLIC STRUCTURE | 5.0 | ◎ |
| COMPARATIVE EXAMPLE6 | INK3 | FLUORINE-CONTAINING HETEROCYCLIC STRUCTURE | 10.0 | ◎ |

Fig. 6

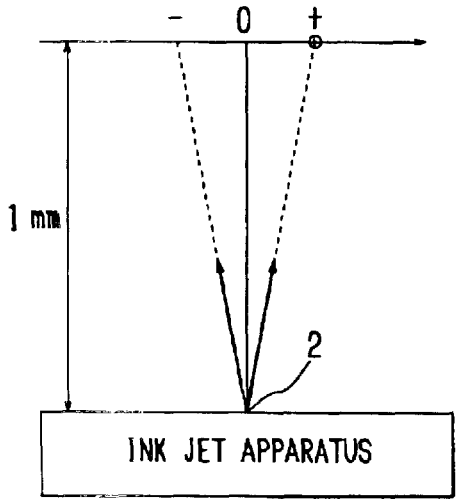

INK JET APPARATUS

BACKGROUND OF THE INVENTION

1. Field of the Invention

The present invention relates to an ink jet apparatus for discharging from a nozzle an ink as ink droplets.

2. Discussion of the Background

For ink jet printers, inks such as water-based inks, oil-based inks, solvent inks and UV inks have been employed. From such various inks, a proper ink is selected as needed, depending on the kind of recording media on which an image is printed by the deposition of the ink or kind of a fixing mechanism adopted by an ink jet printer.

Water-based inks and oil-based inks are generally common in that they are used for water absorbing media. They however differ in fixing mechanism. The water-based inks are fixed by evaporation of a solvent therefrom and penetration of the residue into media upon fixation, while the oil-based inks tend to be fixed only by their penetration into media upon fixation. Since they are both fixed by the penetration into media, fixation to non-absorbing media is very difficult for both of them.

Accordingly, solvent inks have been frequently used for non-absorbing media conventionally. The fixing mechanism of solvent inks however mainly depends on the evaporation of the solvent contained therein so that a system for collecting a volatile organic compound generated upon evaporation of the solvent becomes necessary.

In addition, solvent inks exhibit high volatility so that owing to the evaporation and drying of the solvent, clogging occurs frequently at a nozzle formed in an orifice plate and it sometimes disturbs jetting of ink droplets. It is therefore necessary to carry out maintenance such as spitting or purging at frequent intervals.

Under such circumstances, use of UV inks (ultraviolet curable ink) has attracted attention in recent years. Fixation of UV inks occurs by photo-curing reaction. A photo initiator contained in the inks reacts with a reactive monomer or oligomer to cause transformation into the corresponding polymer. By this, UV inks are fixed well to non-absorbing media. The above-described reaction is completed in so short a time that no solvent is generated. Moreover, owing to very low volatility, they rarely cause clogging, which is a problem of solvent inks resulting from evaporation and drying of a solvent at a nozzle formed in an orifice plate. As such excellent fixation mechanism, low volatility and viscosity reduction of inks are appreciated more, there has increasingly been a demand for ink jet recording system using UV inks for non-absorbing media in recent years.

UV inks are however accompanied with the drawback that the fluidity between the ink and an ink repellent layer formed on the peripheral surface of an ink-jetting nozzle, which surface is a part of the surface (ink ejection side) of an orifice plate equipped with the nozzle, deteriorates with the passage of time. This disturbs straight ejection of ink droplets or increases frequency of misfiring. Such a deterioration in the fluidity of UV inks with the passage of time differ, depending on the combination of the ink repellent layer and ink composition so that it is important to optimize the combination of the ink repellent layer and ink composition in order to prevent such a deterioration.

Such a deterioration in fluidity of the UV inks with the passage of time cannot be grasped by the conventional method of measuring a contact angle between each ink and an ink repellent film. This leads to a difficulty in finding of the most suited combination of the ink repellent layer and UV ink. This problems applies not only UV inks but also the other inks such as inks containing a nonaqueous solvent and colorant.

SUMMARY OF THE INVENTION

An object of the present invention is to find, in a simple manner, a most suited combination of an ink repellent layer formed on the peripheral surface of a nozzle of an orifice plate and an ink, which combination does not cause a deterioration in the fluidity of the ink between the ink repellent layer and the ink even after the passage of time, and to provide an ink jet apparatus capable of stably discharging ink droplets from the nozzle.

The above-described object of the present invention is attained by the novel ink jet apparatus of the present invention.

According to the novel ink jet apparatus of the present invention, an ink repellent layer similar to that having an ink repellent property satisfying a slide-down speed of 2 mm/sec or greater at 25° C. either just after immersion or 100 hours after immersion is formed on at least the peripheral surface of a nozzle which surface constitutes an ink-ejection-side surface of an orifice plate, the speed being determined by a slide-down speed evaluation method for measuring the slide-down speed of ink droplets by immersing a test piece having an ink repellent layer formed on the surface thereof in an ink which is curable by radiation and is to be filled in the pressure chamber of the ink jet apparatus, pulling the test piece out of the ink, fixing the test piece at an angle of 45 degrees with respect to a horizontal plane, and dropping 10 to 20 $\mu$l of the ink to the fixed test piece.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 5 is an explanatory view illustrating the evaluation results of a slide-down speed of the ink and straight ejection property of ink droplets; and FIG. 6 is a schematic view illustrating the test method for evaluating the straight ejection property of ink droplets.

DETAILED DESCRIPTION OF THE PREFERRED EMBODIMENTS

<Ink Jet Apparatus>

Figure 1:
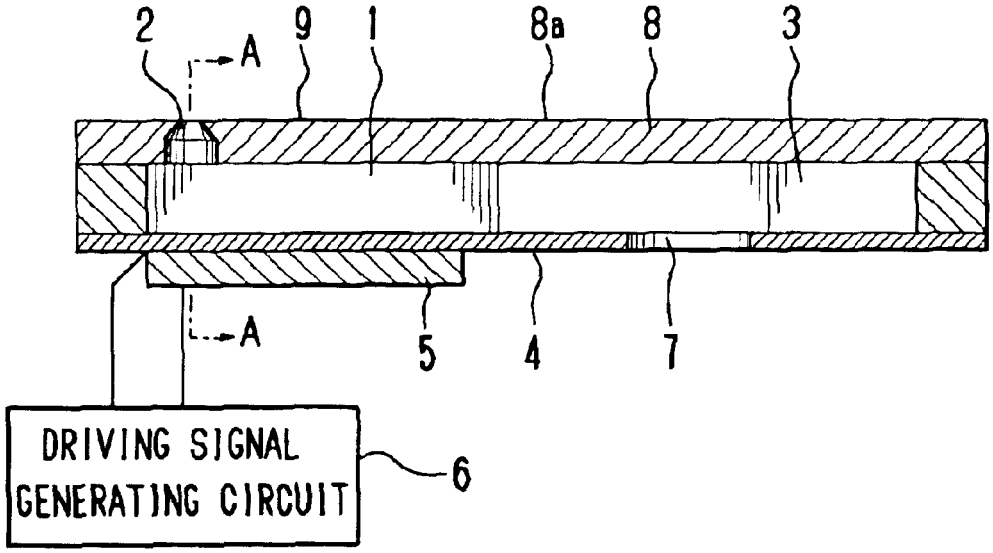
FIG. 1 is a vertical side view of an ink jet apparatus according to one embodiment of the present invention.
Figure 2:
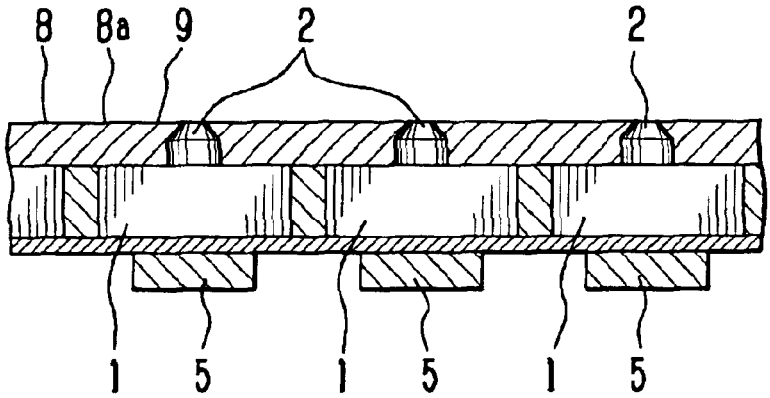
FIG. 2 is a cross-sectional view taken along a line A-A of FIG. 1.
Figure 3:
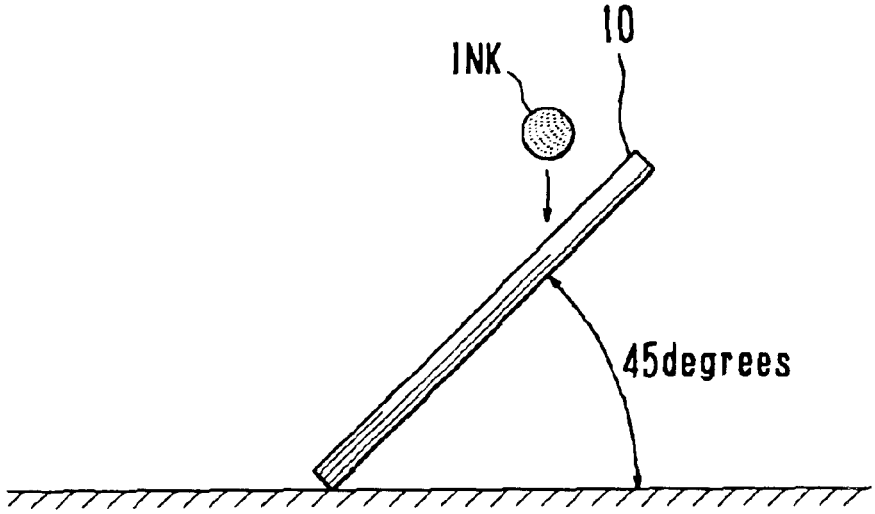
FIG. 3 is a schematic view illustrating a test method for evaluating slide-down speed of an ink.

FIG. 1 is a vertical side view of an ink jet apparatus and FIG. 2 is a cross-sectional view taken along a line A-A of FIG. 1. The ink jet apparatus has a plurality of pressure chambers 1 in which an ink is stored. These pressure chambers 1 are equipped with a nozzle 2 for jetting the ink as ink droplets. These plurality of pressure chambers 1 each has a structure permitting ink supply from a common ink chamber 3. The bottom of each of the pressure chambers 1 is formed from an oscillation plate 4 and to the lower side of this oscillation plate 4, a plurality of piezoelectric members 5 corresponding to the plurality of pressure chambers 1 are fixed. The oscillation plate 4 and piezoelectric member 5 constitute an actuator and the piezoelectric member 5 is electrically connected to an output terminal of a driving signal generating circuit 6. The common ink chamber 3 has an ink feed port 7 for feeding an ink tank (not illustrated) with the ink. The pressure chamber 1 and common ink chamber 3 are filled with the ink fed from the ink tank. The oscillation plate 4, plurality of piezoelectric members 5 and driving signal generating circuit 6 constitute a driving means for jetting, from the nozzle 2, the ink in the pressure chamber 1 as ink droplets.

In such an ink jet apparatus, a driving signal is given from the driving signal generating circuit 6 toward the piezoelectric member 5 to deform the piezoelectric member 5, whereby the oscillation plate 4 is oscillated. By this oscillation of the oscillation plate 4, a pressure is applied to the ink stored in the ink chamber 1 and a portion of the ink is jetted outside as ink droplets.

In this apparatus, the nozzles 2 are formed in an orifice plate 8. In other words, the orifice plate 8 has nozzles 2 each communicating with the pressure chamber 1. An ink repellent layer 9 having an ink repellent property similar to that of another ink repellent layer which has been found to permit the ink to have good fluidity (high slide-down property) as a result of the ink slide-down speed evaluation method, which will be described later, is formed all over the surface 8*a* on the ink ejection side of the orifice plate 8 including the peripheral surface of the nozzle 2. This stabilizes straight ejection property of ink droplets.

In the driving means in this Example, the piezoelectric member 5 is used as an actuator. The actuator is not limited thereto. Instead of the piezoelectric member 5, a heating element may be used as the actuator and in this case, the ink jet apparatus is constituted so as to boil the ink by making use of the heat developed by this heating element, thereby discharging ink droplets from the nozzle 2.

<Slide-down Speed Evaluation Method of Ink>

The slide-down speed evaluation method of ink will next be described. By this method, fluidity of ink can be measured.

Figure 4:
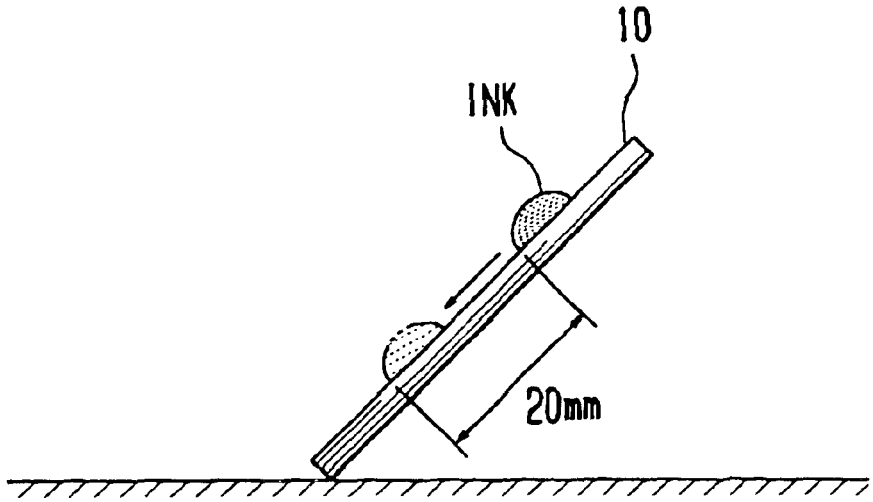
FIG. 4 is a schematic view illustrating the test method for evaluating the slide-down speed of the ink.

The slide-down speed evaluation method of ink is a method for determining a slide-down speed based on the measurement results obtained by immersing a test piece 10 in an ink stored in a container, pulling the test piece out of the ink, fixing the test piece 10 at an angle of 45 degrees with respect to a horizontal plane, dropping 10 to 20 $\mu$l of the ink to the fixed test piece 10 and measuring the time, as illustrated in FIG. 4, required for the dropped ink to slide down the distance of 20 mm.

As the test piece 10, a film having an ink repellent film formed thereon, a glass plate having an ink repellent layer formed directly thereon or the like is usable. Upon use of the film, the film is placed on a glass plate or the like and after the surface of the film is flattened, the slide-down speed evaluation method is performed. This test piece 10 has, for example, a size of 20 mm×80 mm and is marked at 2 points with a predetermined distance therebetween, for example, a 20-mm distance.

The film and glass plate were mentioned above as examples of the base material of the test piece 10 constituting the ink repellent layer, but a base material having another structure may be used upon execution of the test. Any base material is usable insofar as it satisfies the following conditions: having a flat surface, undergoing no change in weight or shape by the ink, and having no adverse effect on the ink.

The time required for the ink to slide down the 20-mm distance is measured for two cases: where the test piece 10 is pulled out of the ink just after immersion therein, and where the test piece is pulled out of the ink after immersion therein for 100 hours.

In this Example, an ink which exhibits the ink slide-down speed at 25° C. of 2 mm/sec or greater on the surface of the test piece 10 is selected and fed to each pressure chamber 1. By using this ink, continuous discharge from the ink jet apparatus can be carried out stably.

The ink capable of satisfying the slide-down speed at 25° C. of 2 mm/sec or greater on the surface of the test piece 10 both just after immersion and 100 hours after immersion as measured by the above-described slide-down speed evaluation method of ink is selected here. This method is adopted based on the test results which will be described next.

The test was conducted using three ultraviolet curable inks (Inks 1, 2 and 3) as follows:

[Ink 1]

Carbon black (coloring material): 1 to 3 wt. %

Radical polymerization type acrylic monomer having a cyclic structure: 50 to 70 wt. %

Radical polymerization type aliphatic urethane acrylate oligomer: 10 to 20 wt. %

Trifunctional acrylate oligomer: 10 to 20 wt. %

α-Aminoketone type radical photoinitiator: 3 to 5 wt. %

Organic polymer dispersant: 0.5 to 3 wt. %

Reactive surface modifier: 0.2 to 1 wt. %

[Ink 2]

Carbon black (coloring material): 1 to 3 wt. %

Radical polymerization type acrylic monomer having a cyclic structure: 50 to 70 wt. %

Radical polymerization type aliphatic urethane acrylate oligomer: 10 to 20 wt. %

Trifunctional acrylate oligomer: 10 to 20 wt. %

α-Aminoketone-type radical photoinitiator: 3 to 5 wt. %

Organic polymer dispersant: 0.5 to 3 wt. %

[Ink 3]

Carbon black (coloring material): 1 to 3 wt. %

Radical polymerization type acrylic monomer having a cyclic structure: 55 to 75 wt. %

Radical polymerization type aliphatic urethane acrylate oligomer: 10 to 20 wt. %

Trifunctional acrylate oligomer: 5 to 15 wt. %

α-Hydroxyketone type radical photoinitiator: 3 to 5 wt. %

Organic polymer dispersant: 0.5 to 3 wt. %

As the ink repellent layer, FEP (Fluorinated Ethylene Propylene copolymer) was prepared.

By using such inks and ink repellent layer, the slide-down speed of each of the inks of Comparative Examples 1 to 3 was measured by carrying out the slide-down speed evaluation method as described above. According to the initial-stage evaluation of this slide-down speed evaluation method, that is, the evaluation of the test piece 10 pulled out of the ink just after immersion therein, the slide-down speeds (flow velocity) of the inks were substantially equal (8 mm/sec). When the test piece 10 was immersed in each of the inks for 100 hours, the slide-down speed (flow velocity) was 0.5 mm/sec in Comparative Example 1, 2.0 mm/sec in Comparative Example 2 and 8.0 mm/sec in Comparative Example 3. This has revealed that even if the same ink repellent layer was employed, the slide-down speed (fluidity of the ink) was different, depending on the composition of the ink.

Next, an ink jet apparatus as illustrated in FIG. 1 was manufactured using FEP as the ink repellent layer 9. By using the resulting ink jet apparatus, ink droplets of each of the inks 1 to 3 were discharged continuously and appearing frequency of the misfiring nozzle 2 was measured. As illustrated in FIG. 5, there appeared a difference in the appearing frequency of misfiring nozzles, depending on a difference in the composition of the inks. Upon ejection test of ink droplets, a driving pulse signal having a frequency of 10 kHz was applied from the driving signal generating circuit 6 to the piezoelectric member 5 and ink droplets were ejected from the nozzle 2 continuously for 1 hour. As illustrated in FIG. 6, when the ink droplets did not exist within a predetermined range at a position 1 mm apart from the nozzle 2 of the ink jet apparatus, such a case was judged that a misfiring nozzle appeared. In these Examples, the predetermined range is set at ±10 $\mu$m. The predetermined range should be determined depending on the using purpose of the ink jet apparatus and should not be limited to the above-described value (±10 $\mu$m).

In FIG. 5, results using FEP as the ink repellent layer are shown as Comparative Examples 1 to 3, while results using an ink repellent layer having a fluorine-containing heterocyclic structure which will be described later are shown as Comparative Examples 4 to 6.

With regards to the appearing frequency of misfiring nozzles, a symbol ◎ means that the appearing frequency of misfiring nozzles is 1/3000 or less per hour, that is, the appearing frequency of misfiring nozzles is 1 or less when ink droplets are ejected continuously for 1 hour from an ink jet apparatus having 3000 nozzles; a symbol ○ means that the appearing frequency of misfiring nozzles ranges from 1/3000 to 1/300 per hour; a symbol Δ means that the appearing frequency of misfiring nozzles ranges from 1/300 to 1/30 per hour; and a symbol X means that the appearing frequency of misfiring nozzles is 1/30 or less per hour.

From FIG. 5, it has been understood that the slower the ink slides down on the ink repellent layer (the fluidity of the ink is worse), the higher the appearing frequency of misfiring nozzles and the worse the straight ejection property of ink droplets, while the higher the slide-down speed of the ink on the ink repellent layer (the fluidity of the ink is better), the lower the appearing frequency of misfiring nozzles and the better the straight ejection property of ink droplets.

In Comparative Examples 4 to 6, shown are the results of the slide-down speed, as measured by the slide-down speed evaluation method just after immersion and 100 hours after immersion, of the ink when each of Inks 1 to 3 and an ink repellent layer having a fluorine-containing heterocyclic structure are combined; and the measurement results of the appearing frequency of misfiring nozzles of an ink jet apparatus manufactured as illustrated in FIG. 1.

As in Comparative Examples 1 to 3, it has been understood that the slower the ink slides down on the ink repellent layer, the higher the appearing frequency of misfiring nozzles and the worse the straight ejection property of ink droplets, while the higher the slide-down speed of the ink on the ink repellent layer, the lower the appearing frequency of misfiring nozzles and the better the straight ejection property of ink droplets.

The above-described results have revealed that a deterioration in ink fluidity, with the passage of time, caused by the contact (immersion) of the ink repellent layer with the ink has a close relationship with the appearing frequency of misfiring nozzles and straight ejection property of ink droplets. In other words, since a change of the ink fluidity with the passage of time relates to a problem which has occurred in the ink repellent layer 9 on the peripheral surface of the nozzle 2 which is a part of the surface 8*a* (ink ejection side) of the actual orifice plate 8 of the ink jet apparatus as illustrated in FIG. 1, it may be an important parameter upon actual ejection of ink droplets from an ink jet head. As shown in FIG. 5, to attain stable continuous ejection and favorable straight discharge property of ink droplets, an ink and an ink repellent layer having an ink repellent property are preferably combined so that the slide-down speed of the ink—as measured by the slide-down speed evaluation method of ink conducted by fixing the test piece 10 at 45 degrees with respect to a horizontal plane—is 2 mm/sec or greater, preferably 5 mm/sec or greater at 25° C. both just after immersion and 100 hours after immersion.

When the fluidity of the ink on the ink repellent layer lowers, the ink adheres to the ink repellent layer and does not slide down smoothly or stops sliding in some portions. Such a phenomenon occurs when the slide-down speed of the ink becomes extremely slow. Supposing that this phenomenon occurs in the ink jet apparatus as illustrated in FIG. 1, when the ink remains on (adheres to) the ink repellent layer 9 on the peripheral surface of the nozzle 2, which is a part of the surface 8*a* (ink ejection side) of the orifice plate 8, owing to a deterioration in ink fluidity, straight ejection of ink droplets is greatly disturbed.

Such remaining (adhesion) of the ink tends to cause misfiring due to trapped bubbles.

In these Examples, a description was made using, as the ink to be evaluated by the slide-down speed evaluation method, a ultraviolet curable ink which cures by an electromagnetic wave in a ultraviolet region, but the ink is not limited thereto. For example, an electron beam curable ink which cures by an electromagnetic wave in the other wavelength region may be usable. In this case, evaluation is carried out in a similar manner to that employed for the ultraviolet curable ink. Then, it is possible to find the most suitable combination of an ink repellent layer and an ink composition that does not deteriorate the fluidity of ink even after the passage of time, and to stably eject ink droplets from a nozzle.

As the ink to be evaluated by the slide-down speed evaluation method, not only inks curable by radiation but also inks containing a non-aqueous solvent such as aliphatic hydrocarbon or mineral spirit and a coloring material (carbon black) as described above in Inks 1 to 3 are usable. In this case, by carrying out the evaluation in accordance with the above-described slide-down speed evaluation method, it is also possible to find the most suitable combination of an ink and an ink repellent layer formed on the peripheral surface of the nozzle in the orifice plate, and to stably discharge ink droplets from a nozzle.

As constituted above, the present invention makes it possible to obtain an ink jet apparatus which permits easy finding of the most suitable combination of an ink repellent layer formed on the peripheral surface of a nozzle and an ink which combination does not undergo a deterioration in the ink fluidity even after the passage of time and is capable of stably discharging ink droplets from a nozzle.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet apparatus, comprising:

a pressure chamber for storing an ink therein;

an orifice plate having a nozzle communicating with the pressure chamber; and a driving means for discharging, from the nozzle, the ink in the pressure chamber as ink droplets, wherein an ink repellent layer similar to another ink repellent layer having an ink repellent property satisfying a slide-down speed of 2 mm/sec or greater at 25° C. either just after immersion or 100 hours after immersion is formed on at least a peripheral surface of the nozzle which surface constitutes an ink-ejection-side surface of the orifice plate, the speed being determined by a slide-down speed evaluation method for measuring the slide-down speed of ink droplets by immersing a test piece having another ink repellent layer formed on the surface thereof in an ink similar to the ink which is stored in the pressure chamber and is radiation curable, pulling the test piece out of the ink, fixing the test piece at 45 degrees with respect to a horizontal plane, and dropping 10 to 20 μl of the ink to the fixed test piece.

2. An ink jet apparatus according to claim 1, wherein the radiation curable ink is an ultraviolet curable ink.

3. An ink jet apparatus according to claim 1, wherein the slide-down speed of the ink determined by the slide-down speed evaluation method is more preferably 5mm/sec or greater at 25° C.

4. An ink jet apparatus according to claim 1, wherein the ink repellent layer has a fluorine-containing heterocyclic structure.

5. An ink jet apparatus, comprising:

a pressure chamber for storing an ink therein;

an orifice plate having a nozzle communicating with the pressure chamber; and a driving means for discharging, from the nozzle, the ink in the pressure chamber as ink droplets, wherein the ink stored in the pressure chamber is radiation curable and satisfies a slide-down speed of 2 mm/sec or greater at 25° C. either just after immersion or 100 hours after immersion, the speed being determined by a slide-down speed evaluation method for measuring the slide-down speed of ink droplets by immersing a test piece having an ink repellent layer formed on the surface thereof in another ink stored in a container, pulling the test piece out of the ink, fixing the test piece at 45 degrees with respect to a horizontal plane, and dropping 10 to 20 μl of the ink to the fixed test piece, and another ink repellent layer having a similar ink repellent property to that of the ink repellent layer employed in the slide-down speed evaluation method is formed on at least a peripheral surface of the nozzle which surface constitutes an ink-ejection-side surface of the orifice plate.

6. An ink jet apparatus according to claim 5, wherein the radiation curable ink is an ultraviolet curable ink.

7. An ink jet apparatus according to claim 5, wherein the slide-down speed of the ink determined by the slide-down speed evaluation method is more preferably 5 mm/sec or greater at 25° C.

8. An ink jet apparatus according to claim 5, wherein the ink repellent layer has a fluorine-containing heterocyclic structure.

9. An ink jet apparatus, comprising:

a pressure chamber for storing an ink therein;

an orifice plate having a nozzle communicating with the pressure chamber; and a driving means for discharging, from the nozzle, the ink in the pressure chamber as ink droplets, wherein an ink repellent layer similar to another ink repellent layer having an ink repellent property satisfying a slide-down speed of 2 mm/sec or greater at 25° C. either just after immersion or 100 hours after immersion is formed on at least a peripheral surface of the nozzle which surface constitutes an ink-ejection-side surface of the orifice plate, the speed being determined by a slide-down speed evaluation method for measuring the slide-down speed of ink droplets by immersing a test piece having the another ink repellent layer formed on the surface thereof in an ink similar to the ink stored in the pressure chamber and containing a nonaqueous solvent and a coloring material, pulling the test piece out of the ink, fixing the test piece at 45 degrees with respect to a horizontal plane, and dropping 10 to 20 μl of the ink to the fixed test piece.

10. An ink jet apparatus according to claim 9, wherein the slide-down speed of the ink determined by the slide-down speed evaluation method is more preferably 5 mm/sec or greater at 25° C.

11. An ink jet apparatus according to claim 9, wherein the ink repellent layer has a fluorine-containing heterocyclic structure.

12. An ink jet apparatus, comprising:

a pressure chamber for storing an ink therein;

an orifice plate having a nozzle communicating with the pressure chamber; and a driving means for discharging, from the nozzle, the ink in the pressure chamber as ink droplets, wherein, the ink stored in the pressure chamber contains a nonaqueous solvent and a coloring material and satisfies a slide-down speed of 2 mm/sec or greater at 25° C. either just after immersion or 100 hours after immersion, the speed being determined by a slide-down speed evaluation method for measuring the slide-down speed of ink droplets by immersing a test piece having an ink repellent layer formed on the surface thereof in another ink stored in a container, pulling up the test piece out of the ink, fixing the test piece at 45 degrees with respect to a horizontal plane, and dropping 10 to 20 μl of the ink to the fixed test piece, and another ink repellent layer having a similar ink repellent property to the ink repellent layer used in the slide-down speed evaluation method has been formed on at least a peripheral surface of the nozzle which surface constitutes an ink-ejection-side surface of the orifice plate.

13. An ink jet apparatus according to claim 12, wherein the slide-down speed of the ink determined by the slide-down speed evaluation method is more preferably 5 mm/sec or greater at 25° C.

14. An ink jet apparatus according to claim 12, wherein the ink repellent layer has a fluorine-containing heterocyclic structure.

* * * * *